US009041626B2

(12) United States Patent
Park et al.

(10) Patent No.: US 9,041,626 B2
(45) Date of Patent: May 26, 2015

(54) ORGANIC LIGHT EMITTING DISPLAY AND POWER SUPPLY METHOD THEREOF

(75) Inventors: Sungcheon Park, Yongin-si (KR); Wook Lee, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 1369 days.

(21) Appl. No.: 12/289,185

(22) Filed: Oct. 22, 2008

(65) Prior Publication Data

US 2009/0109147 A1 Apr. 30, 2009

(30) Foreign Application Priority Data

Oct. 29, 2007 (KR) ..... 10-2007-0108768

(51) Int. Cl.
*G09G 3/30* (2006.01)
*G09G 3/32* (2006.01)
*G09G 3/20* (2006.01)

(52) U.S. Cl.
CPC ..... *G09G 3/3225* (2013.01); *G09G 3/20* (2013.01); *G09G 3/3233* (2013.01); *G09G 2300/0866* (2013.01); *G09G 2310/0251* (2013.01); *G09G 2330/021* (2013.01); *G09G 2330/023* (2013.01); *G09G 2330/028* (2013.01)

(58) Field of Classification Search
None
See application file for complete search history.

(56) References Cited

U.S. PATENT DOCUMENTS 6,292,182 B1 9/2001 Park et al.
7,126,595 B2 10/2006 Yanagi et al.
7,619,598 B2 11/2009 Pulvirenti et al.
2003/0011247 A1* 1/2003 Kajiwara et al. ..... 307/125
2003/0012330 A1* 1/2003 Osame ..... 377/2
2004/0004591 A1* 1/2004 Akimoto et al. ..... 345/84
2004/0252096 A1 12/2004 Wang et al.
2006/0038754 A1* 2/2006 Kim ..... 345/76
2006/0139286 A1 6/2006 Kida et al.
2007/0013613 A1 1/2007 Umezaki
2007/0024540 A1* 2/2007 Ryu et al. ..... 345/76
2007/0046590 A1* 3/2007 Umezaki et al. ..... 345/76
2007/0126690 A1* 6/2007 Chae ..... 345/102

(Continued)

FOREIGN PATENT DOCUMENTS

EP 1 857 999 A1 11/2007
EP 1 895 495 A1 3/2008

(Continued)

OTHER PUBLICATIONS

Japenese Office Action in JP 2008-208202, dated Aug. 30, 2011 (Park, et al.).

(Continued)

*Primary Examiner* — Jesus Hernandez
(74) *Attorney, Agent, or Firm* — Lee & Morse, P.C.

(57) ABSTRACT

An organic light emitting display and power supply method thereof operate an organic light emitting display panel using a high voltage EVLDD and a low voltage ELVSS supplied from a driver integrated circuit during a low power display mode. The organic light emitting display a first power supply configured to supply a first power including a first high voltage and a first low voltage, a second power supply configured to supply a second power including a second high voltage and a second low voltage, and an organic light emitting display panel configured to receive the first power from the first power supply in a standard display mode and configured to receive the second power from the second power supply in a low power display mode.

13 Claims, 5 Drawing Sheets

(56) References Cited

U.S. PATENT DOCUMENTS

| | | | | |
|---|---|---|---|---|
| 2007/0176879 | A1* | 8/2007 | Makino et al. | 345/98 |
| 2008/0024480 | A1 | 1/2008 | Jee et al. | |
| 2008/0218452 | A1 | 9/2008 | Kohno et al. | |

FOREIGN PATENT DOCUMENTS

| | | | |
|---|---|---|---|
| JP | 04-149517 | A | 5/1992 |
| JP | 10-123479 | A | 5/1998 |
| JP | 11-149066 | A | 6/1999 |
| JP | 11-202834 | | 7/1999 |
| JP | 2002-341828 | A | 11/2002 |
| JP | 2003-186445 | | 7/2003 |
| JP | 2003-223122 | A | 8/2003 |
| JP | 2003-280584 | | 10/2003 |
| JP | 2005-168230 | | 6/2005 |
| JP | 2006-171034 | A | 6/2006 |
| JP | 2007-180831 | A | 7/2007 |
| JP | 2007-188098 | A | 7/2007 |
| JP | 2008-224864 | A | 9/2008 |
| KR | 10-2002-0013748 | A | 2/2002 |
| KR | 10-2005-0070855 | A | 7/2005 |
| KR | 10-2007-0053161 | A | 5/2007 |
| KR | 10-2008-0010789 | A | 1/2008 |

OTHER PUBLICATIONS

Japanese Office Action dated Sep. 10, 2013.

* cited by examiner

ORGANIC LIGHT EMITTING DISPLAY AND POWER SUPPLY METHOD THEREOF

BACKGROUND OF THE INVENTION

1. Technical Field

Embodiments relate to an organic light emitting display and power supply method thereof.

2. Description of the Related Art

Organic light emitting displays electrically excite a fluorescent or phosphorescent organic compound to emit light and operate N×M organic light emitting elements to display an image. Organic light emitting elements include an anode (ITO), an organic thin film, and a cathode (metal). The organic thin film has a multi-layer structure of an organic emission layer (EML) that emits light by a combination of electron and holes, an electron transporting layer (ETL) that transports electrons, a hole transporting layer (HTL) that transports holes, an electron injecting layer (EIL) that transports electron, and a hole injecting layer (HIL) that injects holes.

Organic light emitting displays provide good luminous efficiency, brightness, and visible angle, fast response speed, and are lightweight. Organic light emitting displays are used as a display of mobile information terminals, e.g., personal computers, cellular phones, PDAs, or the like, or as a display of various information devices.

Organic light emitting display include a driving circuit, a panel displaying an image, a controller controlling the panel, and a direct current power generator applying a direct current to the panel.

The direct current power generator uses a low voltage, e.g., a battery, as an initial input power. This initial input power then needs to be converted into a desired voltage in order to generate a voltage for emitting an organic light emitting element that is higher than the input power. In order to emit the organic light emitting element, the direct current power generator needs to simultaneously generate a high voltage EVLDD and a low voltage ELVSS, so that the direct current power generator comprises a plurality of devices, which increases a power consumption. The direct current power generator has a great amount of quiescent current, which is higher than a voltage applied to the organic light emitting panel when the organic light emitting panel operates at a low power display mode.

SUMMARY OF THE INVENTION

Embodiments are therefore directed to providing an organic light emitting display and a power supply method thereof, which substantially overcome one or more of the problems and disadvantages of the related art.

It is therefore a feature of an embodiment to provide an organic light emitting display capable of preventing an unnecessary quiescent current consumption caused by a direct current generator at a low power display mode and a power supply method thereof.

It is another feature of an embodiment to provide an organic light emitting display using a high voltage ELVDD and a low voltage ELVSS supplied from a driver integrated circuit during the low power display mode, and a power supply method thereof.

It is yet another feature of an embodiment to provide an organic light emitting display capable of driving an organic light emitting display panel at a low power display mode without adding a charge pump to a driver integrated circuit, since an initial voltage, i.e., a given voltage, generated in the driver integrated circuit at the low power display mode and a voltage applied to a ground and gamma compensation unit, and the like, may be used as a high voltage ELVDD and a low voltage ELVSS operating the organic light emitting display panel, and a power supply method thereof.

At least one of the above and other features and advantages may be realized by providing an organic light emitting display An organic light emitting display, including a first power supply configured to supply a first power including a first high voltage and a first low voltage, a second power supply configured to supply a second power including a second high voltage and a second low voltage, and an organic light emitting display panel configured to receive the first power from the first power supply in a standard display mode and configured to receive the second power from the second power supply in a low power display mode.

The display may further include a first switching element configured to control supply of the first high voltage from the first power supply to the organic light emitting display panel, and a second switching element configured to control supply of the first low voltage from the first power supply to the organic light emitting display panel.

The second power supply may be configured to supply a signal controlling states of the first switching element and the second switching element.

A difference between the second high voltage and the second low voltage is smaller than a difference between the first high voltage and the first low voltage.

The second power supply may include a mode determination unit configured to determine whether a display mode of the organic light emitting display panel is the standard display mode or the low power display mode, a power controller configured to operate the first power supply when the display mode is determined to be the standard display mode and to operate the second power supply when the display mode is determined to be the low power display mode, and a power generator configured to receive an initial voltage from the power controller and to generate the second power.

The power controller may be configured to stop operation of the second power supply when operating the first power supply and to stop operation of the first power supply when operating the second power supply.

The power generator may include a voltage booster configured to receive the initial voltage, boost the initial voltage, and output the second high voltage, and a voltage reducer configured to receive the initial voltage, drop the initial voltage, and output the second low voltage.

The second power supply may include a gamma compensator configured to receive the second high voltage and compensate a gamma value of an image that is output to the organic light emitting display panel.

The second low voltage may be an initialization voltage applied to a pixel of the organic light emitting display panel and initializes a voltage stored in a capacitor of the pixel.

The second low voltage may be a ground voltage applied to the organic light emitting display panel.

The second power supply may be on a same substrate as the organic light emitting display panel.

At least one of the above and other features and advantages may be realized by providing a power supply method of an organic light emitting display, the method including comparing a present display mode of an organic light emitting display panel with a previous display mode to determine whether both display modes are identical to each other, when the display modes are identical, maintaining a present supply of one of a first power and a second power to the organic light emitting display panel, when the display modes of the organic light emitting display panel are not identical, determining whether the display mode is changed from a standard display mode to a low power display mode or from the low power display mode to the standard display mode, and controlling supply of the first power and the second power to the organic light emitting display panel in accordance with a change in the display mode.

When the display mode is changed from the standard display mode to the low power display mode, the method may include turning on a power generator of a second power supply in order to supply the second power to the organic light emitting display panel, and turning off a first power supply to prevent the first power from being supplied to the organic light emitting display panel.

Turning off the first power supply may occur after a data signal of a frame is applied to the organic light emitting display panel.

Turning on the power generator of the second power supply and turning off the first power supply occur during a period other than a period where a synchronous signal is applied to the organic light emitting display and a data signal is applied to the organic light emitting display panel.

When the display mode is changed from the low power display mode to the standard display mode, the method may include turning on the first power supply in order to supply the first power to the organic light emitting display panel, and turning off a power generator of the second power supply in order to prevent the second power from being supplied to the organic light emitting display panel.

Turning on the first power supply may occur after a data signal of a frame is applied to the organic light emitting display.

Turning on the first power supply and turning off the power generator of the second power supply may occur during a period other than a period where a synchronous signal is applied to the organic light emitting display panel and a data signal is applied to the organic light emitting display panel.

The first power may include a first high voltage and a first low voltage, the second power may include a second high voltage and a second low voltage, and a difference between the second high voltage and the second low voltage is less than a difference between the first high voltage and the first low voltage.

Controlling supply of the first and second powers may include stopping supply of the first power when supplying the second power and stopping supply of the second power when supplying the first power.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION OF THE INVENTION

Figure 1:
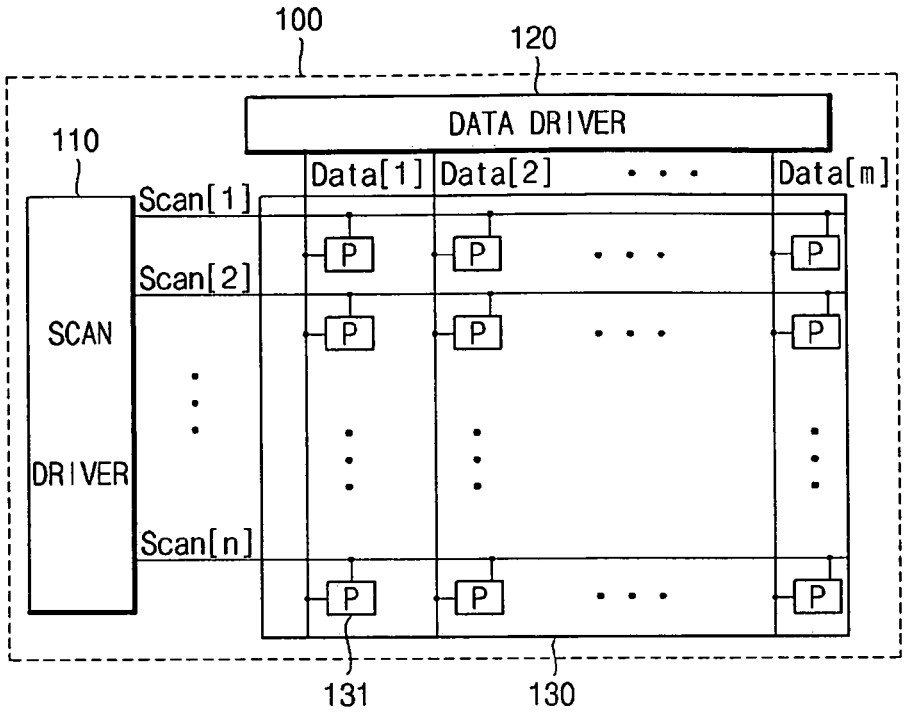
FIG. 1 illustrates a block diagram of an organic light emitting display according to an embodiment.

Korean Patent Application No. 10-2007-0108768, filed on Oct. 29, 2007, in the Korean Intellectual Property Office, and entitled: "Organic Light Emitting Display and Power Supply Method Thereof," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" includes the following meanings: A alone; B alone; C alone; both A and B together; both A and C together; both B and C together; and all three of A, B, and C together. Further, these expressions are open-ended, unless expressly designated to the contrary by their combination with the term "consisting of." For example, the expression "at least one of A, B, and C" may also include an nth member, where n is greater than 3, whereas the expression "at least one selected from the group consisting of A, B, and C" does not.

As used herein, the expression "or" is not an "exclusive or" unless it is used in conjunction with the term "either." For example, the expression "A, B, or C" includes A alone; B alone; C alone; both A and B together; both A and C together; both B and C together; and all three of A, B and, C together, whereas the expression "either A, B, or C" means one of A alone, B alone, and C alone, and does not mean any of both A and B together; both A and C together; both B and C together; and all three of A, B and C together.

Like reference numerals in the drawings denote like elements throughout the specification. It will be understood that when an element is referred to as being "electrically coupled" to another element, the element can be directly electrically coupled to another element or intervening elements may be present.

FIG. 1 illustrates a block diagram of an organic light emitting display 100 according to an embodiment. Referring to FIG. 1, the organic light emitting display 100 may include a scan driver 110, a data driver 120, and an organic light emitting display panel 130 (hereinafter referred to as "panel"). The organic light emitting display 100 may further include power supplies 140 and 150 that will be described in detail with reference to FIG. 3.

The scan driver 110 may sequentially supply a scan signal to the panel 130 through scan lines Scan[1], Scan[2], . . . . Scan[n]. The data driver 120 may supply a data signal to the panel 130 through data lines Data[1], Data[2], . . . . Data[m].

The panel 130 may include the plurality of scan lines Scan[1], Scan[2], . . . . Scan[n] arranged in a row, the plurality of scan lines Data[1], Data[2], . . . . Data[m] arranged in a column, and a pixel circuit 131 defined at an intersection of the plurality of scan lines Scan[1], Scan[2], . . . . Scan[n] and the plurality of scan lines Data[1], Data[2], . . . . Data[m].

The pixel circuit 131 may be formed in a pixel area defined by adjacent two scan lines and adjacent two data lines. As described above, the scan signal may be supplied to the plurality of scan lines Scan[1], Scan[2], . . . . Scan[n] from the scan driver 110, and the data signal may be supplied to the plurality of scan lines Data[1], Data[2], . . . . Data[m] from the data driver 120.

Figure 2:
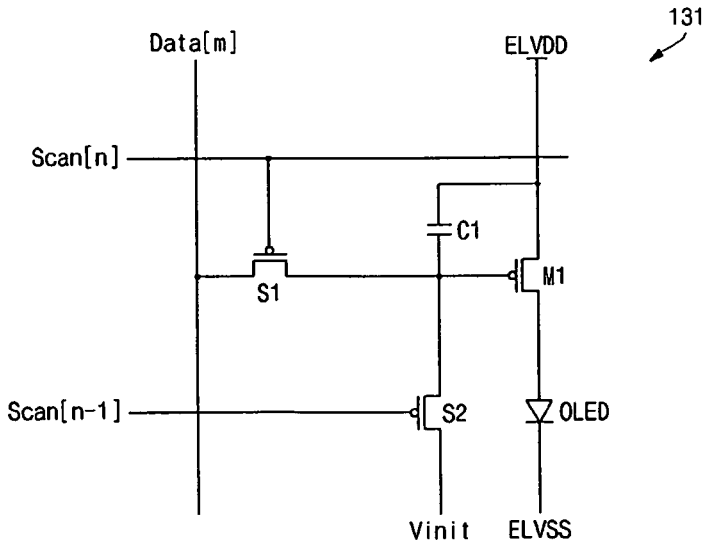
FIG. 2 illustrates a circuit diagram of a pixel circuit of the organic light emitting display illustrated in FIG. 1 according to an embodiment.

FIG. 2 illustrates a circuit diagram of the pixel circuit 131 of the organic light emitting display 100 shown in FIG. 1 according to an embodiment. Referring to FIG. 2, the pixel circuit 131 may include a scan line Scan[n], a previous scan line Scan[n−1], a data line Data[m], a high voltage line ELVDD, a low voltage line ELVSS, an initialization line Vinit, a first switching transistor S1, a second switching transistor S2, and a driving transistor M1, a capacitor C1, and an organic light emitting diode (OLED).

The scan line Scan[n] may supply a scan signal, for selecting the OLED that is to be emitted, to a control electrode of the first switching transistor S1. The scan line Scan[n] may be electrically coupled to the scan driver 110 generating the scan signal.

The previous scan line Scan[n−1] may be coupled to a previously selected $n-1^{st}$ scan line. The previous scan line Scan[n−1] may control the operation of the second switching transistor S2 in order to apply the initialization line Vinit to the OLED.

The data line Data[m] may supply a data signal (voltage) proportional to luminous brightness to a second electrode of the capacitor C1 and a control electrode of the driving transistor M1. The data line Data[m] may be electrically coupled to the data driver 120 that generates the data signal.

The high voltage line ELVDD may supply a high voltage to the OLED. The high voltage line ELVDD may be coupled to the first or second power supplies 140 and 150 (see FIG. 3) supplying power.

The low voltage line ELVSS may supply a low voltage to the OLED. The low voltage line ELVSS may be coupled to the first or second power supplies 140 and 150 (see FIG. 3) supplying power. The high voltage may have generally a higher level than the low voltage.

The initialization line Vinit may supply an initialization voltage to the capacitor C1. The initialization voltage may initialize a voltage stored in the capacitor C1 of a previous frame. The initialization voltage may be applied from the second power supply 150 (see FIG. 3). The initialization voltage may be the same as the low voltage.

The first switching transistor S1 may include a first electrode (a drain electrode or a source electrode) electrically coupled to the data line Data[m], a second electrode (a source electrode or a drain electrode) electrically coupled to the control electrode (a gate electrode) of the driving transistor M1, and a control electrode electrically coupled to the scan line Scan[n]. When turned on, the first switching transistor S1 may supply the data signal to the second electrode of the capacitor C1 and the control electrode of the driving transistor M1.

The second switching transistor S2 may include a first electrode electrically coupled to the initialization line Vinit, a second electrode electrically coupled to the control electrode of the driving transistor M1, and a control electrode electrically coupled to the previous scan line Scan[n−1]. The second switching transistor S2 may be turned on when a scan signal of a low level is applied to the control electrode through the previous scan line Scan[n−1] and may initialize the voltage stored in the capacitor C1.

The driving transistor M1 may include a first electrode electrically coupled to the high voltage line ELVDD, a second electrode electrically coupled to an anode of the OLED, and the control electrode electrically coupled to the second electrode of the first switching transistor S1. If a data signal of a lower level (or a negative voltage) is applied to the driving transistor M1 that is a P type channel transistor through the control electrode, the driving transistor M1 may supply a predetermined amount of current from the high voltage line ELVDD to the OLED. The data signal of the low level (or the negative voltage) may be supplied to the second electrode of the capacitor C1 to charge the second electrode. Thus, although the first switching transistor S1 is turned off, the data signal of the low level (or the negative voltage) may be continuously applied to the control electrode of the driving transistor M1 during a predetermined period of time by a charge voltage of the capacitor C1.

Figure 3:
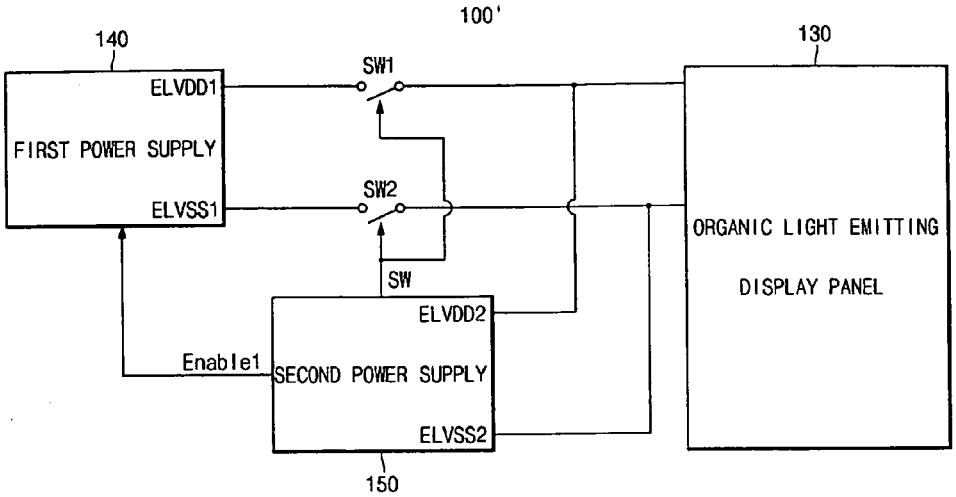
FIG. 3 illustrates a block diagram of an organic light emitting display according to an embodiment.

FIG. 3 illustrates a block diagram of an organic light emitting display 100' according to another embodiment. Referring to FIG. 3, the organic light emitting display 100' may include the panel 130, the first power supply 140, the second power supply 150, a first switching element SW1 and a second switching element SW2. The organic light emitting display 100' may further include the scan driver 110 and the data driver 120 shown in FIG. 1. However, the scan driver 110 and the data driver 120 described with reference to FIG. 1 are not repeated in FIG. 3 for clarity.

ELVDD1 represents a first high voltage terminal and a first high voltage. ELSS1 represents a first low voltage terminal and a first low voltage. ELVDD2 represents a second high voltage terminal and a second high voltage. ELVSS2 represents a second low voltage terminal and a second voltage. Thus, the same reference denotes both voltage terminal and voltage.

The panel 130 may receive voltages ELVDD and ELVSS from the first power supply 140 and the second power supply 150, and may supply the voltages ELVDD and ELVSS to each pixel circuit 131 (see FIG. 2) in accordance with an operational mode of the panel 130. The high voltage ELVDD and the low voltage ELVSS may be supplied to the pixel circuit 131, causing a driving current to flow from the voltage ELVDD to the low voltage ELVSS through the OLED. The driving current may correspond to a data signal applied to the pixel circuit 131.

The first power supply 140 may include the first high voltage terminal ELVDD1 and the first low voltage terminal ELVSS1 electrically coupled to the panel 130 through switching elements SW1 and SW2. The first power supply 140 may supply the first high voltage terminal ELVDD1 and the first low voltage terminal ELVSS1, which are first power ELVDD1 and ELVSS1, to the panel 130. The first power supply 140 may receive a first enable signal Enable1 from the second power supply 150 and may supply power to the panel 130 when the panel 130 operates at a standard display mode, i.e., a general image display mode. The first power supply 140 may stop supplying power to the panel 130 when the panel 130 operates at a low power display mode. The first power supply 140 may include a DC-DC converter as a direct current generator.

When the organic light emitting display 100' uses a low voltage, e.g., a battery, as initial input power, the initial power needs to be converted to a desired voltage by boosting or dropping a voltage in order to generate a higher voltage than the input power to operate an OLED. In more detail, the first high voltage ELVDD1 and the first low voltage ELVSS1 having a large voltage difference therebetween may be simultaneously generated to operate the OLED. Thus, the first power supply 140 may include numerous elements, which increases power consumption. The first power supply 140 may have a high quiescent current whose power consumption is greater than that applied to the panel 130 operating in the lower power display mode. The first power supply 140 may supply the first power ELVDD1 and ELVSS1 to the panel 130 only during the standard display mode in order to prevent a quiescent current consumption when the panel 130 operates in the low power display mode.

When the panel 130 operates in the low power display mode, the second high voltage ELVDD2 and the second low voltage ELVSS2 are supplied to the panel 130. A voltage difference between the second power ELVDD2 and ELVSS2 is smaller than that of the first power ELVDD1 and ELVSS1 applied by the first power supply 140. However, during the low power display mode, the panel 130 may partially operate at low power, so the small voltage difference between the second power ELVDD2 and ELVSS2 may be sufficient to operate the panel 130. Thus, the second power supply 150 may be used to supply the voltage to the panel 130 during the low power display mode, thereby reducing a power consumption caused by the quiescent current generated by the operation of the first power supply 140.

The second power supply 150 may include a driver integrated circuit (IC), which may be formed on a same substrate as the panel 130. The driver IC may be formed as a single element, e.g., a transistor. The second power ELVDD2 and ELVSS2 may boost or drop an initial voltage Vin that is the input voltage using a charge pump of the driver IC.

The second high voltage ELVDD2 may use the same voltage as a voltage applied to a gamma compensation unit (see FIG. 4) that adjusts and compensates a gamma value of the data driver. The second low voltage ELVSS2 may use the same voltage as the initialization voltage Vinit applied to the pixel circuit 131 (see FIG. 2). The second low voltage ELVSS2 may use a ground voltage GND coupled to a ground ring in the organic light emitting display 100. When voltages used by the panel 130 are used as the second power ELVDD2 and ELVSS2 of the second power supply 150, the second power supply 150 does not need a charge pump, thereby reducing the size of the second power supply 150. Alternatively, the second low voltage ELVSS2 may be generated by dropping the initial voltage Vin, i.e., the input voltage, using a charge pump and may generate a lower voltage than the initial voltage Vin.

In a general organic light emitting display, the first high voltage ELVDD1 is about 4.6V and the first low high voltage ELVSS1 is −5.4V, thus providing a voltage difference of 10V. In accordance with an embodiment, the voltage generated in the second power supply 150 and applied to the gamma compensation unit may be about 4.2V. The initialization voltage Vinit may be about −2.0V. The second low voltage ELVSS2 may be dropped to −4.0V using the charge pump. The second high voltage ELVDD2 may use the voltage (4.2V) applied to the gamma compensation unit. The second low voltage ELVSS2 may use the voltage (−4.0V) generated by the charge pump, the initialization voltage (−2.0V), or a ground voltage (0V). A voltage difference between the second high voltage ELVDD2 and the second low voltage ELVSS2 applied to the panel 130 may be 8.2V, 6.2V, and 4.2V when the second high voltage ELVDD2 is 4.2V and the second low voltage ELVSS2 uses the voltage generated by using the charge pump, the initialization voltage, and the ground voltage, respectively. Since the second high voltage ELVDD2 and the second low voltage ELVSS2 supply the voltage to the panel 130 during the low power display mode, the panel 130 may be operated when the voltage difference (e.g., 8.2V, 6.2V, and 4.2V) between the second high voltage ELVDD2 and the second low voltage ELVSS2 is smaller than the voltage difference (e.g., 10V) between the first high voltage ELVDD1 and the first low voltage ELVSS1 that are applied by the first power supply 140.

The first switching element SW1 may be electrically coupled between the first high voltage terminal ELVDD1 of the first power supply 140 and the panel 130. The first switching element SW1 may be turned on when the panel 130 operates in the standard display mode, i.e., other than the low power display mode, and may transfer the first high voltage ELVDD1 to the panel 130. The first switching element SW1 may be turned on when a switching signal SW is received indicating that the panel 130 operates in the standard display mode.

The second switching element SW2 may be electrically coupled between the first low voltage terminal ELVSS1 of the first power supply 140 and the panel 130. The second switching element SW2 may be turned on when the panel 130 operates in the standard display mode, i.e., other than the low power display mode, and may transfer the first low voltage ELVSS1 to the panel 130. The second switching element SW2 may be turned when the switching signal SW is received indicating that the panel 130 operates in the standard display mode, i.e., may operate in the same manner as the first switching element SW1.

The first and second switching elements SW1 and SW2 may be turned off during the low power display mode to prevent the second power ELVDD2 and ELVSS2 of the second power supply 150 from being applied to the first power supply 140 through the first high voltage terminal ELVDD1 and the first low voltage terminal ELVSS1 of the first power supply 140. Without the first and second switching elements SW1 and SW2, when the second power supply 150 applies the second power ELVDD2 and ELVSS2 to the panel 130 at the low power display mode, the second power ELVDD2 and ELVSS2 would also be applied to the first high voltage terminal ELVDD1 and the first low voltage terminal ELVSS1 of the first power supply 140.

However, if the first high voltage terminal ELVDD1 and the first low voltage terminal ELVSS1 of the first power supply 140 have a high impedance value, the second power ELVDD2 and ELVSS2 applied by the second power supply 150 is not applied to the first power supply 140 through the first high voltage terminal ELVDD1 and the first low voltage terminal ELVSS1. Hence, if the first high voltage terminal ELVDD1 and the first low voltage terminal ELVSS1 of the first power supply 140 have the high impedance value, the second power ELVDD2 and ELVSS2 may be prevented from being applied to the first power supply 140 without the first switching element SW1 and the second switching element SW2.

Figure 4:
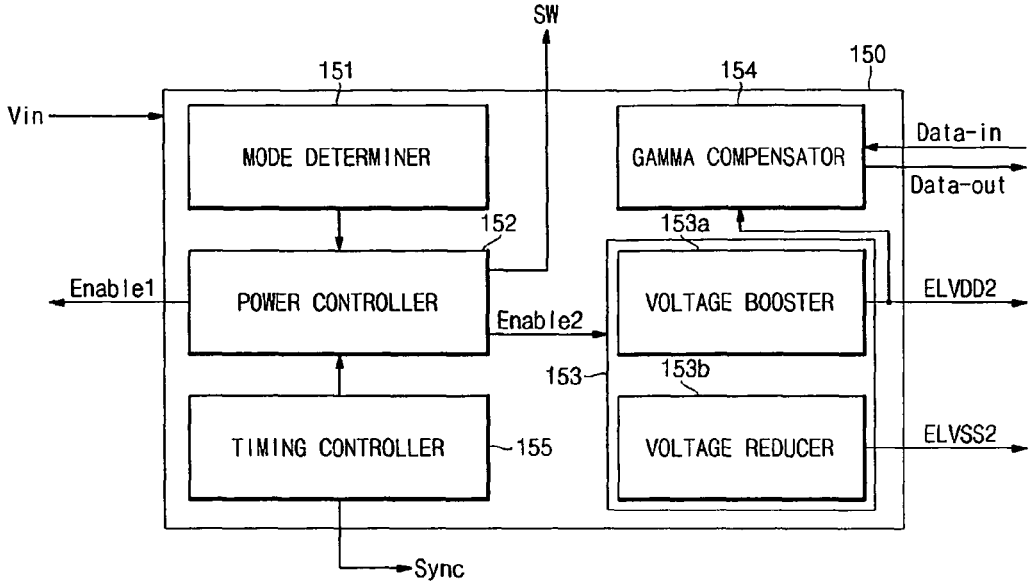
FIG. 4 illustrates a block diagram of a second power supply of FIG. 3 according to an embodiment.

FIG. 4 illustrates a block diagram of the second power supply 150 of FIG. 3 according to an embodiment. Referring to FIG. 4, the second power supply 150 may include a mode determiner 151, a power controller 152, a power generator 153, a gamma compensator 154, and a timing controller 155.

The mode determiner 151 may be coupled between the panel 130 and the power controller 152, and may determine whether a display mode of the panel 130 is the standard display mode or the low power display mode. The mode determiner 151 may compare the display mode of the panel 130 of a previous frame and the display mode of the panel 130 of a current frame. If both display modes are the same, the first power supply 140 and the second power supply 150 may operate in the same manner as in the previous frame. The mode determiner 151 may supply the determined mode to the power controller 152.

The power controller 152 may be coupled between the mode determiner 151 and the power generator 153, may supply a second enable signal Enable2 to the power generator 153 according to a mode from the mode determiner 151, and may control the operation of the power generator 153. The power controller 152 may be electrically coupled to the first power supply 140, may supply the first enable signal Enable1 to the first power supply 140 (see FIG. 3), and may control the operation of the first power supply 140. The power controller 152 may be electrically coupled to a control electrode of the first and second switching elements SW1 and SW2 (see FIG. 3), may supply the switching signal SW to the first and second switching elements SW1 and SW2, and may control the operation of the first and second switching elements SW1 and SW2.

The power generator 153 may include a voltage booster 153*a* and a voltage reducer 153*b*. The voltage booster 153*a* may boost the initial power Vin and may generate the second high voltage ELVDD2. The voltage reducer 153*b* may drop the initial voltage Vin and may generate the second low voltage ELVSS2. The voltage booster 153*a* and the voltage reducer 153*b* may supply the second power ELVDD2 and ELVSS2 to the panel 130. The power generator 153 may receive the second enable signal Enable2 from the power controller 152, may operate during the low power display mode of the panel 130, and may cease to operate during the standard display mode of the panel 130.

The second high voltage ELVDD2 output from the voltage booster 153*a* of the power generator 153 may be supplied to the gamma compensator 154. By using the same voltage as that applied to the gamma compensator 154 as the second high voltage ELVDD2, the second power supply 150 does not need the voltage booster 153*a*, thereby reducing the size of the second power supply 150. The second low voltage ELVSS2 output from the power generator 153 may use the same voltage as the initialization voltage Vinit applied to the pixel 131 (see FIG. 2), the ground voltage GND coupled to the ground ring formed in the organic light emitting display 100, or a voltage generated by using a separate voltage reducer. By using the same voltage as the initialization voltage Vinit or the ground voltage GND as the second low voltage ELVSS2, the second power supply 150 does not need the separate voltage reducer 153*b*, thereby reducing the size of the second power supply 150.

The power generator 153 may further include a voltage booster and a voltage reducer that generate the voltage applied to the scan driver 110, the data driver 120, and the panel 130, besides the voltage booster 153*a* and the voltage reducer 153*b*.

The gamma compensator 154 may be coupled between the power generator 153 and the data driver 120, may receive the second high voltage ELVDD2 from the power generator 153, may compensate a gamma value of a data voltage Data_in applied from the data driver 120, and may output the compensated data voltage Data_in to the data driver 120.

The timing controller 155 may be coupled to the scan driver 110, the data driver 120, the panel 130, and the power supplies 140 and 150 of the organic light emitting display 100', may generate a synchronous signal Sync, and may supply the synchronous signal Sync to the scan driver 110, the data driver 120, the panel 130, and the power supplies 140 and 150. The synchronous signal Sync may simultaneously notify the scan driver 110, the data driver 120, the panel 130, and the power supplies 140 and 150 of a start of a frame.

Figure 5:
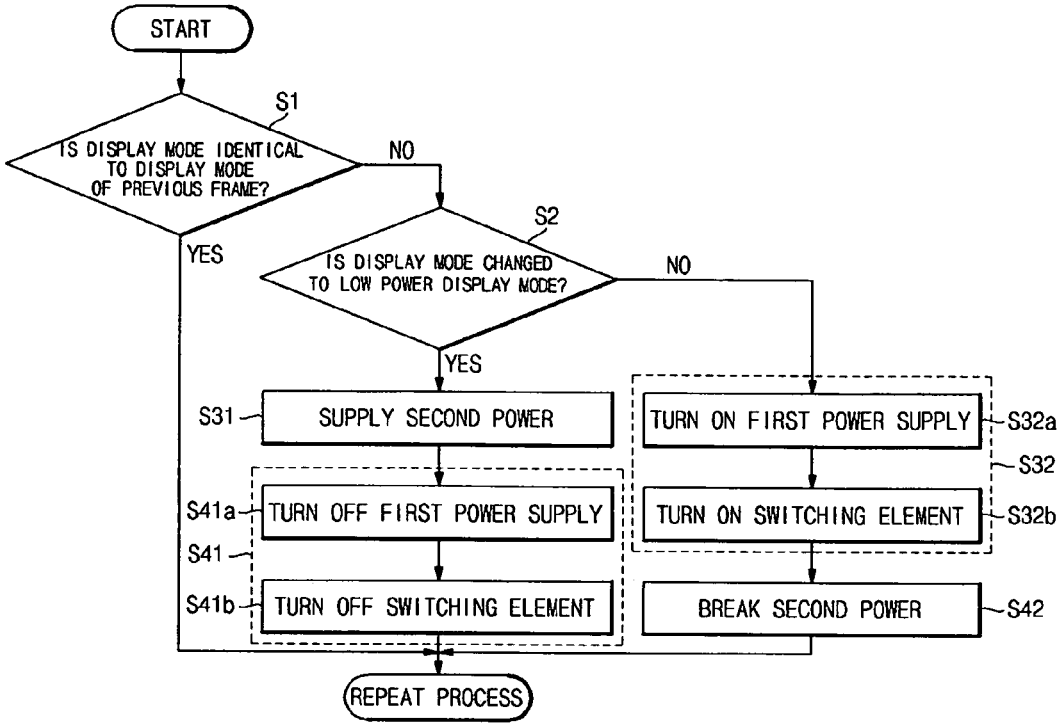
FIG. 5 illustrates a flowchart of a power supply method of an organic light emitting display according to an embodiment.

FIG. 5 illustrates a flowchart of a power supply method of the organic light emitting display according to an embodiment. Referring to FIG. 5, the power supply method may include a display mode comparing operation (S1), a display mode determining operation (S2), a second power supplying operation (S31), a first power breaking operation (S41), a first power supplying operation (S32), and a second power breaking operation (S42). The second power supplying operation (S31) and the first power breaking operation (S41) may be performed when a display mode changes from the standard display mode to the low power display mode as determined in the display mode determining operation (S2). The first power supplying operation (S32) and the second power breaking operation (S42) may be performed when the display mode changes from the low power display mode to the standard display mode as determined by the display mode determining operation (S2). The second power supplying operation (S31), the first power breaking operation (S41), the first power supplying operation (S32), and the second power breaking operation (S42) may be performed during periods where the synchronous signal Sync notifying a start of a frame at the same time is applied to the scan driver 110, the data driver 120, the panel 130, and the power supplies 140 and 150

In the display mode comparing operation (S1), it is determined whether the display mode of the panel 130 is the same as the display mode of a previous frame. If the display mode of the panel 130 is the same as the display mode of the previous frame, the same power as that of the previous frame is supplied, and the process may be repeated. If the display mode of the panel 130 is not the same as the display mode of a previous frame, the display mode determining operation (S2) proceeds.

In the display mode determining operation (S2), when the display mode of the panel changes from the standard display mode to the low power display mode, the second power supplying operation (S31) proceeds and, when the display mode of the panel changes from the low power display mode to the standard display mode, the first power supplying operation (S32) proceeds. In more detail, when the display mode of the panel changes from the standard display mode to the low power display mode, power is supplied to the panel 130 from the second power supply 150 and, when the display mode of the panel changes from the low power display mode to the standard display mode, power is supplied to the panel 130 from the first power supply 140.

In the second power supplying operation (S31), when the display mode of the panel 130 changes from the standard display mode to the low power display mode in the display mode determining operation (S2), the second power supply 150 receives the second enable signal Enable2 and is turned on, and the second power ELVDD2 and ELVSS2 is supplied to the panel 130. Since the display mode of the panel 130 is the standard display mode in a previous frame before the second power supplying operation (S31) proceeds, the first power supply 140 applies the first power ELVDD1 and ELVSS1 to the panel 130. Therefore, if the second power supply 150 applies the second power ELVDD2 and ELVSS2 to the panel 130, the first power ELVDD1 and ELVSS1 applied in the first power supply 140 and the second power ELVDD2 and ELVSS2 applied in the second power supply 150 are respectively coupled, i.e., shorted. Such a short results in a voltage change from the first power ELVDD1 and ELVSS1 applied from the first power supply 140 and the second power ELVDD2 and ELVSS2 applied from the second power supply 150, reducing the voltage applied to the panel 130, thereby reducing or preventing a screen error caused by the voltage change.

In the first power breaking operation (S41), the first power supply 140 is turned off after the first power ELVDD1 and ELVSS1 and the second power ELVDD2 and ELVSS2 are shorted. The first power breaking operation (S41) may include an operation of turning off the first power supply 140 (S41*a*) and an operation of turning off the first and second switching elements SW1 and SW2 (S41*b*). In the operation S41*b*, the first and second switching elements SW1 and SW2 that are electrically coupled between the first power supply 140 and the panel 130 are turned off, preventing a leakage current from flowing in the first power supply 140 when the second power supply 150 applies the second power ELVDD2 and ELVSS2 to the panel 130. The operation S41*b* proceeds after a data signal of a frame is applied to the panel 130. The data signal of a frame is input into the panel 130 between the operations S41*a* and S41*b*. In this regard, if a data signal of a black image is applied to the entire panel 130, when the display mode of the panel 130 changes, the voltage change may prevent an error in a screen of the panel 130.

In the first power supplying operation (S32), if the display mode is changed from the low power display mode to the standard display mode in the display mode determining operation (S2), the first power supply 140 receives the first enable signal Enable1 and is turned on, and the first and second switching elements SW1 and SW2 are turned on and supply the first power ELVDD1 and ELVSS1 to the panel 130. The first power supplying operation (S32) may include an operation of turning on the first power supply 140 (S32*a*) and an operation of turning on the first and second switching elements SW1 and SW2 (S32*b*). In the operation S32*a*, the first power supply 140 receives the first enable signal Enable1 and is turned on, and applies the first power ELVDD1 and ELVSS1 to the first and second switching elements SW1 and SW2. In the operation S32*b*, the first and second switching elements SW1 and SW2 that are electrically coupled between the first power supply 140 and the panel 130 are turned on, and transfer the first power ELVDD1 and ELVSS1 to the panel 130.

The operation S32*b* may proceed after a data signal of a frame is applied to the panel 130. The data signal of a frame may be input into the panel 130 between the operations S41*a* and S41*b*. In this regard, a data signal of a frame is applied to the panel 130 between the operations S32*a* and S32*b*. If a data signal of a black image is applied to the entire panel 130, when the display mode of the panel 130 changes, the voltage change may prevent an error in a screen of the panel 130. Since the display mode of the panel 130 is the low power display mode in a previous frame before the operation S32*a* proceeds, the second power supply 150 applies the second power ELVDD2 and ELVSS2 to the panel 130. Therefore, if the first power supply 140 applies the first power ELVDD1 and ELVSS1 to the panel 130, the first power ELVDD1 and ELVSS1 applied in the first power supply 140 and the second power ELVDD2 and ELVSS2 applied in the second power supply 150 are shorted. Such a short results in a voltage change from the first power ELVDD1 and ELVSS1 applied in the first power supply 140 and the second power ELVDD2 and ELVSS2 applied in the second power supply 150, and reduces the voltage applied to the panel 130, thereby preventing a screen error caused by the voltage change.

In the second power breaking operation (S42), the second power supply 150 is turned off and the second power ELVDD2 and ELVSS2 stops being applied to the panel 130 after the first power ELVDD1 and ELVSS1 and the second power ELVDD2 and ELVSS2 are shorted in the first power supplying operation (S32), thereby preventing a screen error caused by the voltage change.

Figure 6A:
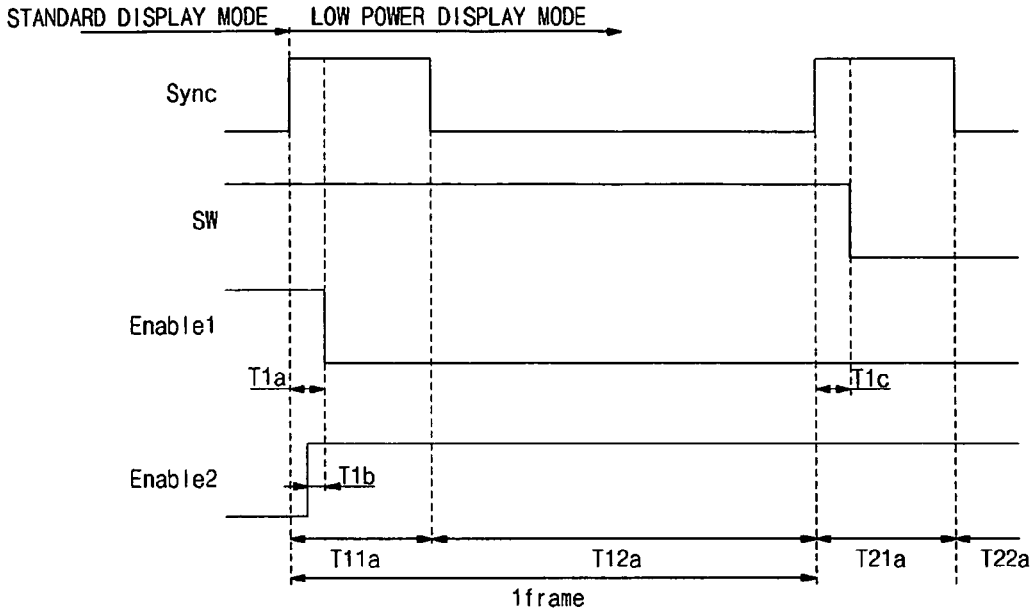
FIGS. 6A and 6B illustrate timing diagrams of a power supply method of the organic light emitting display of FIG. 3 according to an embodiment.
Figure 6B:
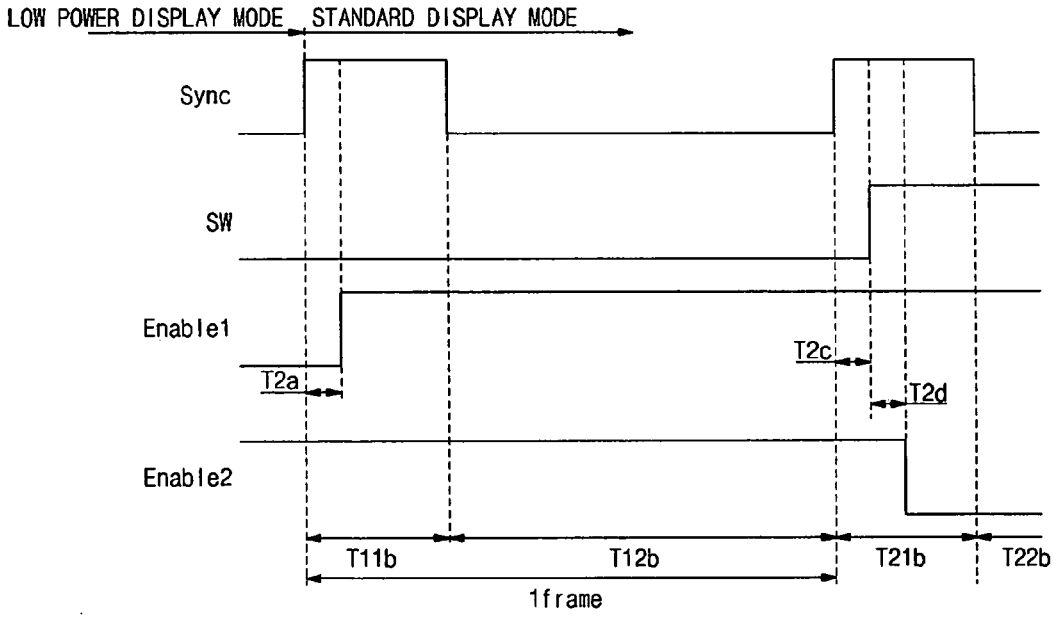

FIGS. 6A and 6B illustrate timing diagrams of a power supply method of the organic light emitting display of FIG. 3 according to an embodiment of the present invention. The timing diagram shown in FIG. 6A illustrates the second power supplying operation (S31) and the first power breaking operation (S41). The timing diagram shown in FIG. 6B illustrates the first power supplying operation (S32) and the second power breaking operation (S42).

Referring to FIG. 6A, a frame may include synchronous signal input periods T11*a* and T21*a*, and data signal input periods T12*a* and T22*a*. In the synchronous signal input periods T11*a* and T21*a*, a synchronous signal Sync notifying a start of a frame may be simultaneously applied to the scan driver 110, the data driver 120, the panel 130, and the power supplies 140 and 150. In the data signal input periods T12*a* and T22*a*, the data signal may be applied to the panel 130. Thus, the pixel circuit 131 of the panel 130 and the OLED may operate. The second power supplying operation (S31) and the first power breaking operation (S41) may be performed during the synchronous signal input periods T11*a* and T21*a*.

As illustrated in FIG. 6A, when the display mode of the panel 130 changes from the standard display mode to the low power display mode, the first power ELVDD1 and ELVSS1 applied in the first power supply 140 is stopped after the first period T1*a* elapses, e.g., when the first enable signal Enable1 becomes low. The second power supply 150 is turned on and the second power ELVDD2 and ELVSS2 is applied to the panel 130 during the first period T1*a*. In more detail, the first power ELVDD1 and ELVSS1 is stopped after the second power supply 150 applies the second power ELVDD and ELVSS2 to the panel 130 so that the first power ELVDD1 and EVLSS1 and the second power ELVDD2 and EVLSS2 are simultaneously applied to the panel 130 during a second period T1*b*. At this time, a voltage changes from the first power ELVDD1 and EVLSS1 to the second power ELVDD2 and EVLSS2, the voltage applied to the panel 130 is reduced, thereby preventing a screen error caused by the voltage change.

The switching elements SW1 and SW2 may be turned off after the display mode of the panel 130 changes from the standard display mode to the low power display mode, one frame passes, and a third period T1*c* elapses. When the switching elements SW1 and SW2 are turned off, a leakage current flowing from the first power supply 140 when the second power supply 150 applies the second power ELVDD2 and ELVSS2 to the panel 130 is stopped. If a data signal of a black image is applied to the data signal input period T12*a* of one frame, the voltage change may prevent an error in a screen of the panel 130 when the display mode of the panel 130 changes.

Referring to FIG. 6B, a frame may include synchronous signal input periods T11*b* and T21*b*, and data signal input periods T12*b* and T22*b*. In the synchronous signal input periods T11*b* and T21*b*, a synchronous signal Sync, notifying a start of a frame, may be simultaneously applied to the scan driver 110, the data driver 120, the panel 130, and the power supplies 140 and 150. In the data signal input periods T12*b* and T22*b*, the data signal may be applied to the panel 130. Thus, the pixel circuit 131 and the OLED operate. The first power supplying operation (S32) and the second power breaking operation (S42) may be performed during the synchronous signal input periods T11*b* and T21*b*.

When the display mode of the panel 130 changes from the low power display mode to the standard display mode, the first power supply 140 may be turned on and the first power ELVDD1 and ELVSS1 may be applied to the first and second switching elements SW1 and SW2 after a first period T2*a* elapses. The first and second switching elements SW1 and SW2 are turned off so that the first power ELVDD1 and ELVSS1 is not supplied to the panel 130.

The switching elements SW1 and SW2 may be turned on after the display mode of the panel 130 changes from the low power display mode to the standard display mode, one frame passes, and a third period T2*c* elapses. When the switching elements SW1 and SW2 are turned on, the first power ELVDD1 and ELVSS1 of the first power supply 140 is supplied to the panel 130 after the third period T2*c* is elapsed. If a data signal of a black image is applied during the data signal input period T12*b* of one frame, the voltage change may prevent an error in a screen of the panel 130 when the display mode of the panel 130 changes. The second power ELVDD2 and ELVSS2 may be applied to the panel 130 in the second power supply 150 after a fourth period T2*d* elapses.

In more detail, since the second power ELVDD2 and ELVSS2 applied in the second power supply 150 is broken after the first power ELVDD1 and ELVSS1 is applied to the panel 130 from the first power supply 140, the first power ELVDD1 and ELVSS1 of the first power supply 140 and the second power ELVDD2 and ELVSS2 of the second power supply 150 may be simultaneously applied during the fourth period T2*d*. At this time, a voltage change is made from the second power ELVDD2 and ELVSS2 applied from the second power supply 150 to the first power ELVDD1 and ELVSS1 applied from the first power supply 140. Thus, the voltage applied to the panel 130 is reduced, thereby preventing a screen error caused by the voltage change.

The organic light emitting display and power supply method thereof according to embodiments may apply a high voltage ELVDD and a low voltage ELVSS for operating an OLED in a pixel to an organic light emitting display panel 100' using a driver integrated circuit instead of a direct current generator during a low power display mode, thereby removing an unnecessary quiescent current consumption caused by the direct current generator during the low power display mode.

Further, the organic light emitting display and power supply method thereof according to embodiments may use, during the low power display, an initial voltage, i.e., a given voltage generated in a driver integrated circuit, or a ground voltage as a low voltage ELVSS, and a voltage applied to gamma compensation unit and the like as a high voltage ELVDD, thereby driving the organic light emitting display panel in the low power display mode without adding a charge pump to the drive integrated circuit.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light emitting display, comprising:

a first power supply to receive an initial voltage and to supply a first power including a first high voltage and a first low voltage;

a second power supply to supply a second power including a second high voltage and a second low voltage; and an organic light emitting display panel having a display mode including a standard display mode and a low power display mode, the organic light emitting display panel to receive the first power from the first power supply in the standard display mode and to receive the second power from the second power supply in the low power display mode, wherein:

the second power supply includes a gamma compensator to receive the second high voltage directly and to compensate a gamma value of an image that is output to the organic light emitting display panel, the first high voltage is generated by boosting the initial voltage, and the first low voltage is generated by dropping the initial voltage, and the second high voltage and the second low voltage are the voltages used by the organic light emitting display panel, and whether the display mode is changed or not is determined by each frame.

2. The display as claimed in claim 1, further comprising:

a first switching element to determine whether the first high voltage from the first power supply is supplied to the organic light emitting display panel or the second high voltage from the second power supply is supplied to the organic light emitting display panel according to a state of the first switching element; and a second switching element to determine whether the first low voltage from the first power supply is supplied to the organic light emitting display panel or the second low voltage from the second power supply is supplied to the organic light emitting display panel according to a state of the second switching element.

3. The display as claimed in claim 2, wherein the second power supply is to supply a signal controlling the states of the first switching element and the second switching element.

4. The display as claimed in claim 1, wherein a difference between the second high voltage and the second low voltage is smaller than a difference between the first high voltage and the first low voltage.

5. The display as claimed in claim 1, wherein the second power supply comprises:

a mode determination unit to determine whether the display mode of the organic light emitting display panel is the standard display mode or the low power display mode by each frame;

a power controller to operate the first power supply when the display mode is determined to be the standard display mode and to operate the second power supply when the display mode is determined to be the low power display mode; and a power generator to receive the initial voltage from the power controller and to generate the second power.

6. The display as claimed in claim 5, wherein the power controller is to stop operation of the second power supply when operating the first power supply and to stop operation of the first power supply when operating the second power supply.

7. The display as claimed in claim 5, wherein the power generator comprises:

a voltage booster to receive the initial voltage, boost the initial voltage, and output the second high voltage; and a voltage reducer to receive the initial voltage, drop the initial voltage, and output the second low voltage.

8. The display as claimed in claim 1, wherein the second low voltage is an initialization voltage applied to a pixel of the organic light emitting display panel and initializes a voltage stored in a capacitor of the pixel.

9. The display as claimed in claim 1, wherein: the second high voltage is the initial voltage, and the second low voltage is a ground voltage applied to the organic light emitting display panel.

10. The display as claimed in claim 1, wherein the second power supply is on a same substrate as the organic light emitting display panel.

11. The display as claimed in claim 1, wherein the second power supply has a smaller quiescent current consumption than the first power supply.

12. The display as claimed in claim 1, wherein when the display mode of a current frame is changed from the display mode of a previous frame, the organic light emitting display panel displays a black image in the current frame.

13. The display as claimed in claim 2, wherein when the display mode of a current frame is changed from the display mode of a previous frame, the states of the first switching element and the second switching element is changed in a next frame.

* * * * *